US006344097B1

(12) United States Patent
Limoges et al.

(10) Patent No.: US 6,344,097 B1
(45) Date of Patent: Feb. 5, 2002

(54) SURFACE TREATMENT OF AUSTENITIC NI-FE-CR-BASED ALLOYS FOR IMPROVED RESISTANCE TO INTERGRANULAR-CORROSION AND-CRACKING

(75) Inventors: David L. Limoges, Toronto; Gino Palumbo, Etobicoke; Peter K. Lin, Toronto, all of (CA)

(73) Assignee: Integran Technologies Inc., Toronto (CA)

( * ) Notice: Subject to any disclaimer, the term of this patent is extended or adjusted under 35 U.S.C. 154(b) by 0 days.

(21) Appl. No.: 09/579,527

(22) Filed: May 26, 2000

(51) Int. Cl.[7] ..... C22F 1/10

(52) U.S. Cl. ..... 148/592; 148/593; 148/676; 148/677

(58) Field of Search ..... 148/516, 525, 148/529, 592, 593, 676, 677

(56) References Cited

U.S. PATENT DOCUMENTS 4,424,083 A * 1/1984 Polizzotti et al. ..... 148/592
4,816,217 A * 3/1989 Bassford et al. ..... 148/442
5,625,664 A * 4/1997 Berkley ..... 378/72
5,932,120 A * 8/1999 Mannava et al. ..... 148/525

FOREIGN PATENT DOCUMENTS

JP 61-229481 * 10/1986

* cited by examiner

*Primary Examiner*—George Wyszomierski
(74) *Attorney, Agent, or Firm*—Ridout & Maybee LLP

(57) ABSTRACT

A surface treatment process for enhancing the intergranular corrosion and intergranular cracking resistance of components fabricated from austenitic Ni—Fe—Cr based alloys comprised of the application of surface cold work to a depth in the range of 0.01 mm to 0.5 mm, for example by high intensity shot peening, followed by recrystallization heat treatment preferably at solutionizing temperatures (>900 C.). The surface cold work and annealing process can be repeated to further optimize the microstructure of the near-surface region. Following the final heat treatment, the process can optionally comprise the application of surface cold work of reduced intensity, yielding a cold worked depth of 0.005 mm to 0.01 mm, in order further enhance resistance to cracking by rendering the near surface in residual compression.

13 Claims, 3 Drawing Sheets

SURFACE TREATMENT OF AUSTENITIC NI-FE-CR-BASED ALLOYS FOR IMPROVED RESISTANCE TO INTERGRANULAR-CORROSION AND-CRACKING

FIELD OF THE INVENTION

This invention relates to a process for the surface treatment of articles fabricated of austenitic iron-nickel-chromium based alloys, to resist and to deter the onset of intergranular cracking and corrosion. The process comprises at least one cycle of cold deformation of the near surface region, for example by high intensity shot peening, followed by recrystallization heat treatment. The novel process can be applied to wrought, cast or welded materials, and is particularly suited for in-situ or field application to components such as steam generator tubes or core reactor head penetrations of nuclear power plants.

DESCRIPTION OF PRIOR ART

The prior art presents examples of the use of surface cold work, for example by "shot peening", to effect a state of residual compression at the surface of a material, and thus render the material resistant to the initiation of cracks which require a tensile stress for initiation and propagation. Shot peening is a method of cold working, inducing compressive stresses on and near the surface layer of metallic parts. The process consists of impinging on the test article a stream of shot, directed at the metal surface at high velocity under controlled conditions.

Although peening cleans the metal surface, the major purpose is to impact and enhance fatigue strength. Peening processes are known to relieve tensile stresses that contribute to stress-corrosion cracking. Yamada in U.S. Pat. No. 5,816,088 (1998) describes a surface treatment method for a steel workpiece using high speed shot peening. Mannava in U.S. Pat. No. 5,932,120 (1999) describes a laser shock peening apparatus using a low energy laser. Harman and Lambert in U.S. Pat. No. 4,481,802 (1984) describe a method of peening the inside of a small diameter tube in order to relieve residual tensile stresses.

Friske and Page in U.S. Pat. No. 3,844,846 (1974) describe a surface deformation treatment by shot peening, which is applied to austenitic Cr—Fe—Ni alloys without subsequent heat treatment, in order to render the surface region highly deformed, and subsequently more resistant to intergranular corrosion in the event that the article becomes exposed to sensitization temperatures, i.e., 400–700° C., during service.

Kinoshita and Masamune in U.S. Pat. No. 4,086,104 (1978) also describe a surface deformation treatment for austenitic stainless steel components, applied following final mill annealing or hot rolling treatments, which renders the surface of the stainless steel more resistant to oxide scale formation during subsequent exposure to high temperature steam.

Anello in U.S. Pat. No. 4,495,002 (1985) describes a three step process for martensitic stainless steels to increase their resistance to chloride corrosion, wherein, an article is subjected to surface deformation via shot peening, followed by an aging treatment at 527–549° C., and followed by a final lower intensity shot peening. In such manner, a homogeneous near surface region consisting of aged martensite is obtained which is resistant to chloride corrosion and cracking.

Palumbo in U.S. Pat. No. 5,702,543 (1997) and U.S. Pat. No. 5,817,193 (1998), describes thermomechanical mill processes involving the application of bulk cold work, such as cold drawing or cold rolling, followed by a recrystallization heat treatment to improve the grain boundary microstructure of austenitic Ni—Fe—Cr alloys and thereby effect significant improvements in intergranular corrosion- and cracking-resistance.

We have discovered that finished and semi-finished articles made of austenitic Ni—Fe—Cr alloys, whether in the wrought, forged, cast or welded condition, may be subjected to cold deformation of the near surface region by a technique such as shot peening, followed by annealing of the article at a temperature below its melting point for a time sufficient to induce recrystallization in the cold-worked near surface region. In this specification, "near surface region" refers to the surface layer of the article to a depth in the range from 0.01 mm to about 0.5 mm.

SUMMARY OF THE INVENTION

It is a principal object of this invention to provide a surface treatment methodology which will alter the recrystallized structure in the near surface region of a finished article or component made of austenitic Ni—Fe—Cr alloys to impart significant resistance to intergranular corrosion and cracking during service of the article or component, without the need for bulk deformation thereof by a process of rolling, extruding, forging or the like.

It is a further object of this invention to provide a surface treatment process as aforesaid, which may be used to treat and improve the degradation and corrosion resistance of finished parts of complex shape and parts which may already be in service, in particular, nuclear steam generator tubes, nuclear reactor head penetrations and the like.

With a view to achieving these objects, there is provided a method for improving intergranular corrosion and cracking resistance of an article fabricated of an austenitic Ni—Fe—Cr alloy by subjecting the alloy to at least one cycle comprising the steps of:

(i) cold working the surface region of the article to a depth in the range of from 0.01 mm to about 0.5 mm; and (ii) annealing the article at a temperature below the melting point of said alloy for a time sufficient to induce recrystallization in said surface region.

BRIEF DESCRIPTION OF THE DRAWINGS

Preferred embodiments of the invention are described in detail below, with reference to the drawings. The three figures are comparative cross-sectional optical micrographs of an austenitic alloy, in which:

FIG. 1(*b*) is a sample of the same Alloy 625 material but subsequent to treatment by a single cycle of surface deformation (shot peening) and recrystallization, according to the present invention; and FIG. 1(*c*) is an optical micrograph for the same alloy, which has been treated according to two cycles of the process according to the present invention.

PREFERRED EMBODIMENTS OF THE INVENTION

As is known by those skilled in the metallurgical art, cold working involves mechanical deformation of an article at a low enough temperature that dislocations are retained, leading to a structure of non-recrystallized, deformed grains. Hot working, on the other hand, results in an article having primarily recrystallized grains.

This invention relies on cold-working the surface layer of the article, followed by an annealing treatment which results in recrystallization of the deformed region. Shot peening is a non-conventional method of cold-working in which compressive stresses are induced in the exposed surface layers of metallic parts by the impingement of a stream of shot, directed at the surface at high velocities under controlled conditions. When shot in a high-intensity stream contacts the test article surface, they produce light, rounded depressions in the surface, causing a plastic flow to extend up to 0.5 mm (0.02") below the surface. The metal beneath this layer remains unaffected. The penetration depth of the peening into the exposed surface of the article can be controlled by the hardness, weight and size of the shot and the impact velocity.

The heat-treatment of the austenitic Ni—Fe—Cr article, following the peening, is carried out at temperatures and times sufficient to allow complete recrystallization to occur, and which are sufficient to ensure that chromium carbides are dissolved and retained as elemental Cr and C in solid solution. The peening and heat treatment can optionally be repeated a number of times to achieve optimum homogeneity in near-surface microstructure. Also, a final lower intensity surface deformation may be applied following heat treatment in order to impart compressive stresses in the near surface of the treated article. In the case of precipitation hardenable austenitic Ni—Fe—Cr alloys, the final recrystallization treatment or reduced intensity peening treatment may be followed by an aging heat treatment to effect the precipitation of strengthening phases.

EXAMPLE 1

Figure 1A:
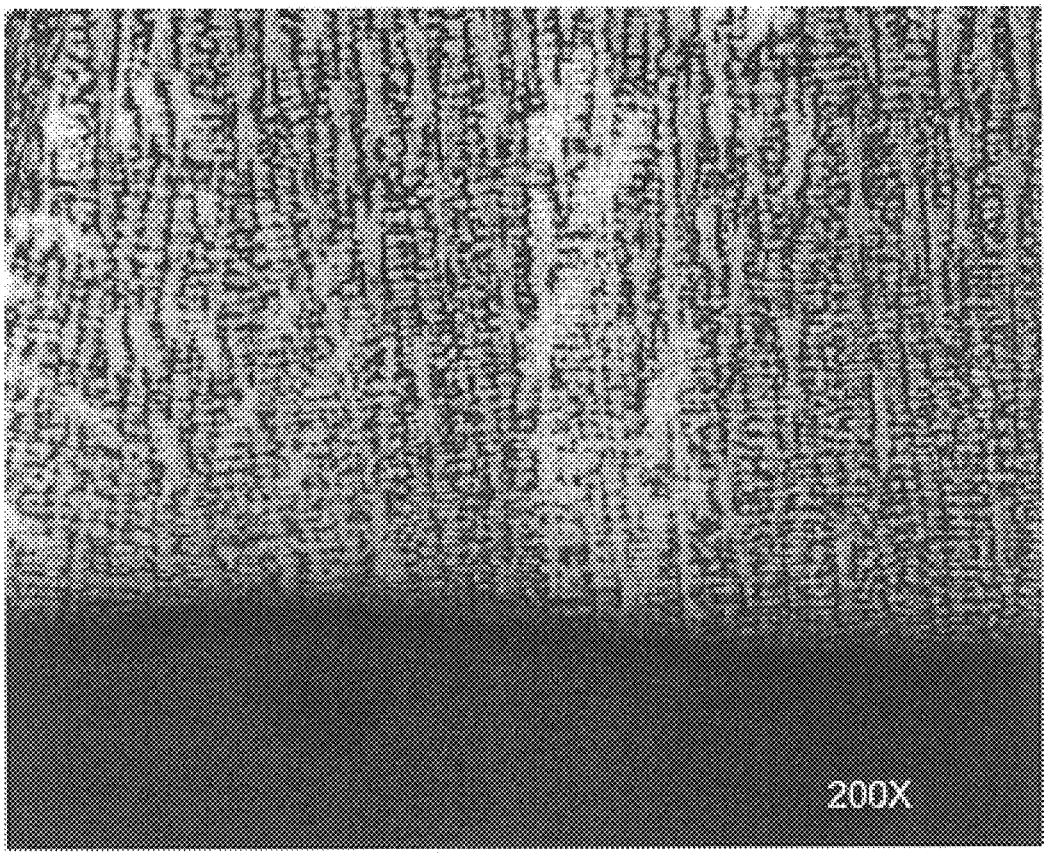
FIG. 1(*a*) is a micrograph of as-received Alloy 625.
Figure 1B:
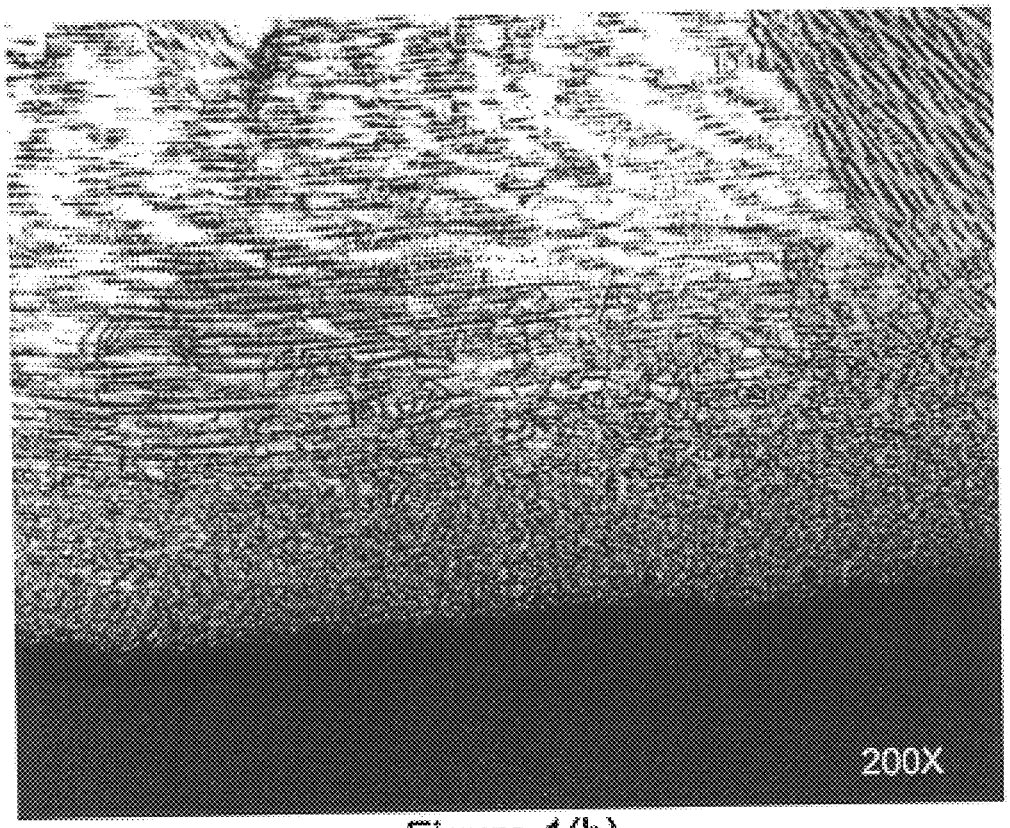
Figure 1C:
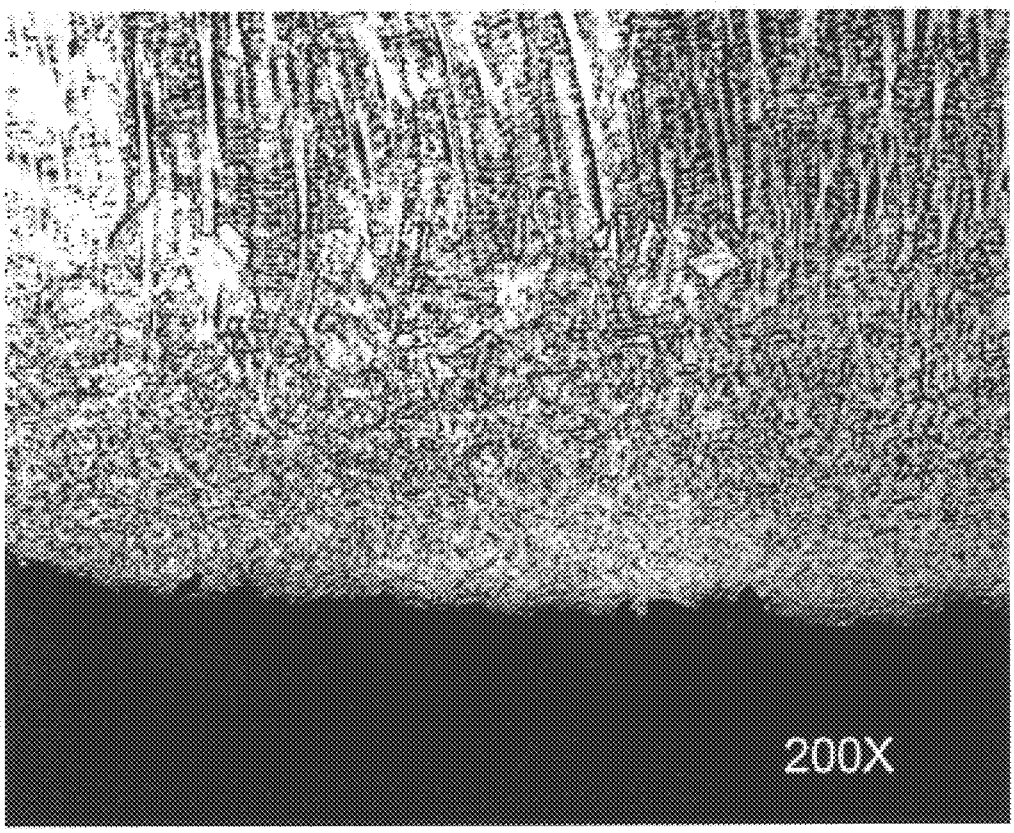

A section of austenitic weld overlay Alloy 625 (chemical composition: 61.0% Ni, 21.4% Cr, 8.2% Mo, and 9.4% Fe) was obtained in the as-cast condition. Samples of the material were treated according to the preferred embodiments of this invention, whereby exposed surface were shot peened according to the conditions outlined in Table 1. Following each peening cycle, the samples were recrystallized at a temperature of 1000° C. (1850° F.) for 5 minutes and air cooled. FIG. 1 shows cross-sectional optical micrographs of (a) the as-received material (F), and (b), (c) material treated by the preferred embodiments of this invention, in one and two cycles (G-1, G-2), respectively.

As noted is these micrographs, the treated materials display a recrystallized surface layer extending approximately 0.005 in. into the specimens.

Treated samples and the as-received materials were subsequently subjected to a 'sensitization' heat treatment which simulates a manufacturing stress relief protocol; this treatment was applied as follows: samples were heated to a target temperature of 1650° F. (899° C.) at a heating rate of 400° F. (204° C.) per hour from room temperature; the samples were held at 1650° F. (899° C.) for 20 minutes, and subsequently furnace cooled to a temperature of 600 F. (315° C.), and then air cooled to room temperature.

All samples were subsequently corrosion tested as per ASTM G28A to evaluate resistance to intergranular corrosion arising from sensitization. The test involves 120 hour exposure in boiling ferric sulfate-sulfuric acid. Replicated samples of approximately 0.0615 in×0.5 in.×2 in. were accurately dimensioned to determine exposed surface area and weighed to 1 mg accuracy prior to, and following exposure in order to establish mass loss, and corrosion rate in mils per year.

Table 2 summarizes the measured corrosion performance. As-received and sensitized material (F), not treated according to the preferred embodiments of this invention display a corrosion rate of 393 mils per year. Material treated by the preferred embodiments of this invention and subsequently sensitized displays a marked improvement in sensitization- and corrosion-resistance with G-1 and G-2 specimens displaying similar average corrosion rates of 40 and 41 mils per year respectively.

TABLE 1

Details of applied shot peening parameters

| Shot Peening | Time | Hardened Steel Shot Size | Air Pressure (psi) |
|---|---|---|---|
| One Cycle | 7 minutes | 0.028 in. | 80 |
| Two Cycles | (1) 7 minutes | 0.028 in. | 80 |
| | (2) 5 minutes | 0.028 in. | 80 |

TABLE 2

Sample nomenclature and process descriptions and G-28 Corrosion Results

| Sample | Process conditions | Average Corrosion Rate (mils/year) |
|---|---|---|
| F | As Received + Sensitization Treatment | 393 |
| G-1 | Single cycle + Sensitization Treatment | 40 |
| G-2 | Two cycles + Sensitization Treatment | 41 |

By using the process of the invention, a wide variety of articles may, without bulk deformation, be treated to increase significantly their resistance to corrosion.

We claim:

1. A method for improving intergranular corrosion and cracking resistance of an article fabricated of an austenitic Ni—Fe—Cr alloy by subjecting the alloy to at least one cycle comprising the steps of:

(i) cold working only the near surface region of the article to a depth in the range of from 0.01 mm to about 0.5 mm so as to leave the material composing the article below said depth substantially unaffected; and (ii) annealing the article at a temperature greater than 900° C. and below the melting point of said alloy for a time sufficient to induce recrystallization in said near surface region.

2. A method according to claim 1, wherein said cold working comprises shot peening of the surface of the article.

3. A method according to claim 2, wherein said article is a nuclear steam generator tube.

4. A method according to claim 2, wherein the article is a nuclear reactor core head penetration.

5. A method according to claim 2, wherein said article is annealed for a time between 5 minutes and 20 minutes.

6. A method according to claim 1, wherein said cold working comprises laser peening of the surface of the article.

7. A method according to claim 1, wherein said cold working comprises hammer peening of the surface of the article.

8. A method according to claim 1, wherein following completion of the final cycle of said steps (i) and (ii), the article is subjected to surface cold work of an intensity less than that applied in step (i).

9. A method according to claim 8, wherein following said surface cold work of less intensity, the article is subjected to an ageing heat treatment to precipitate strengthening phases.

10. A method according to claim 1, wherein following completion of the final cycle of said steps (i) and (ii), the article is subjected to ageing heat treatment to precipitate strengthening phases.

11. A method according to claim 1, wherein successive treatment steps (i) and (ii) are applied only to a localized surface region of said article.

12. A method according to claim 11, wherein said localized region is a weld.

13. A method according to claim 12, wherein said localized region is the heat-affected zone of a weld.

* * * * *